US011147998B2

(12) United States Patent
Wang

(10) Patent No.: US 11,147,998 B2
(45) Date of Patent: Oct. 19, 2021

(54) EXERCISE DEVICE

(71) Applicant: C2P (TAIWAN) LTD., Taichung (TW)

(72) Inventor: Chin-Liu Wang, Taichung (TW)

(73) Assignee: C2P (TAIWAN) LTD., Taichung (TW)

( * ) Notice: Subject to any disclaimer, the term of this patent is extended or adjusted under 35 U.S.C. 154(b) by 43 days.

(21) Appl. No.: 16/733,441

(22) Filed: Jan. 3, 2020

(65) Prior Publication Data

US 2021/0205650 A1 Jul. 8, 2021

(51) Int. Cl.

| | |
|---|---|
| ***A63B 21/005*** | (2006.01) |
| ***A63B 21/008*** | (2006.01) |
| ***A63B 22/06*** | (2006.01) |
| ***A63B 21/00*** | (2006.01) |
| *A63B 71/00* | (2006.01) |

(52) U.S. Cl.

CPC .... *A63B 21/0052* (2013.01); *A63B 21/00072* (2013.01); *A63B 21/0088* (2013.01); *A63B 22/0605* (2013.01); *A63B 2071/009* (2013.01)

(58) Field of Classification Search

CPC ..... A63B 21/00058; A63B 21/00192; A63B 21/005; A63B 21/0051; A63B 21/0052; A63B 21/0053; A63B 21/0056; A63B 21/0057; A63B 22/0605; A63B 2022/0611; A63B 2071/009

See application file for complete search history.

(56) References Cited

U.S. PATENT DOCUMENTS

| | | | | |
|---|---|---|---|---|
| 2016/0298654 | A1* | 10/2016 | Wang | F04D 17/16 |
| 2018/0140896 | A1* | 5/2018 | Chen | A63B 22/02 |
| 2019/0083839 | A1* | 3/2019 | Wang | A63B 22/06 |
| 2019/0217142 | A1* | 7/2019 | Hsu | A63B 21/0088 |
| 2019/0255376 | A1* | 8/2019 | Wu | A63B 21/00076 |
| 2020/0306580 | A1* | 10/2020 | Wang | A63B 21/0088 |

* cited by examiner

*Primary Examiner* — Garrett K Atkinson
*Assistant Examiner* — Zachary T Moore
(74) *Attorney, Agent, or Firm* — Muncy, Geissler, Olds & Lowe, P.C.

(57) ABSTRACT

An exercise device is provided, including: a main body, two fan wheels and a magnetic resistance assembly. The main body includes an axle disposed thereon. The two fan wheels are connected to the axle and rotatable relative to the main body. The magnetic resistance assembly includes two magnetoresistive rings disposed respectively on the two fan wheels and around the axle, a magnetic unit and a controlling unit. The magnetic unit includes two magnetic portions respectively corresponding to the two magnetoresistive rings. The controlling unit includes a lever rotatably disposed on the main body at a pivot point, and the magnetic unit and an operating portion are disposed on the lever and located by two opposite sides with respect to the pivot point. The pivot point and the axle are eccentrically arranged.

9 Claims, 6 Drawing Sheets

EXERCISE DEVICE

BACKGROUND OF THE INVENTION

Field of the Invention

The present invention relates to an exercise device.

Description of the Prior Art

Recently, people pay more attention to exercise and physical health. However, due to the crowded environment, poor air quality of the urban area or bad weather, people tend to exercise indoors, for example, using exercise devices such as rowing machine, treadmill, exercise bike or the like in a gym to conduct weight training and maintain physical health and fitness.

Specifically, a conventional fan-type exercise bike includes a main body, a fan wheel disposed on the main body and a magnetic resistance unit which is configured to provide different resistance according to using requirements. However, the conventional fan-type exercise bike has insufficient resistance, which cannot meet using requirements; the magnetic resistance unit has a complicated structure, which is inconvenient to manufacture and maintain.

The present invention is, therefore, arisen to obviate or at least mitigate the above-mentioned disadvantages.

SUMMARY OF THE INVENTION

The main object of the present invention is to provide an exercise device which provides sufficient operating resistance and has a simple magnetic resistance adjusting structure.

To achieve the above and other objects, the present invention provides an exercise device, including: a main body, two fan wheels and a magnetic resistance assembly. The main body includes an axle disposed thereon. The two fan wheels are connected to the axle and rotatable relative to the main body. The magnetic resistance assembly includes two magnetoresistive rings disposed respectively on the two fan wheels and around the axle, a magnetic unit and a controlling unit. The magnetic unit includes two magnetic portions respectively corresponding to the two magnetoresistive rings. The controlling unit includes a lever rotatably disposed on the main body at a pivot point, and the magnetic unit and an operating portion are disposed on the lever and located by two opposite sides with respect to the pivot point. The pivot point and the axle are eccentrically arranged. Movement of the two magnetic portions driven by the lever changes magnetic active force between the two magnetic portions and the two magnetoresistive rings.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
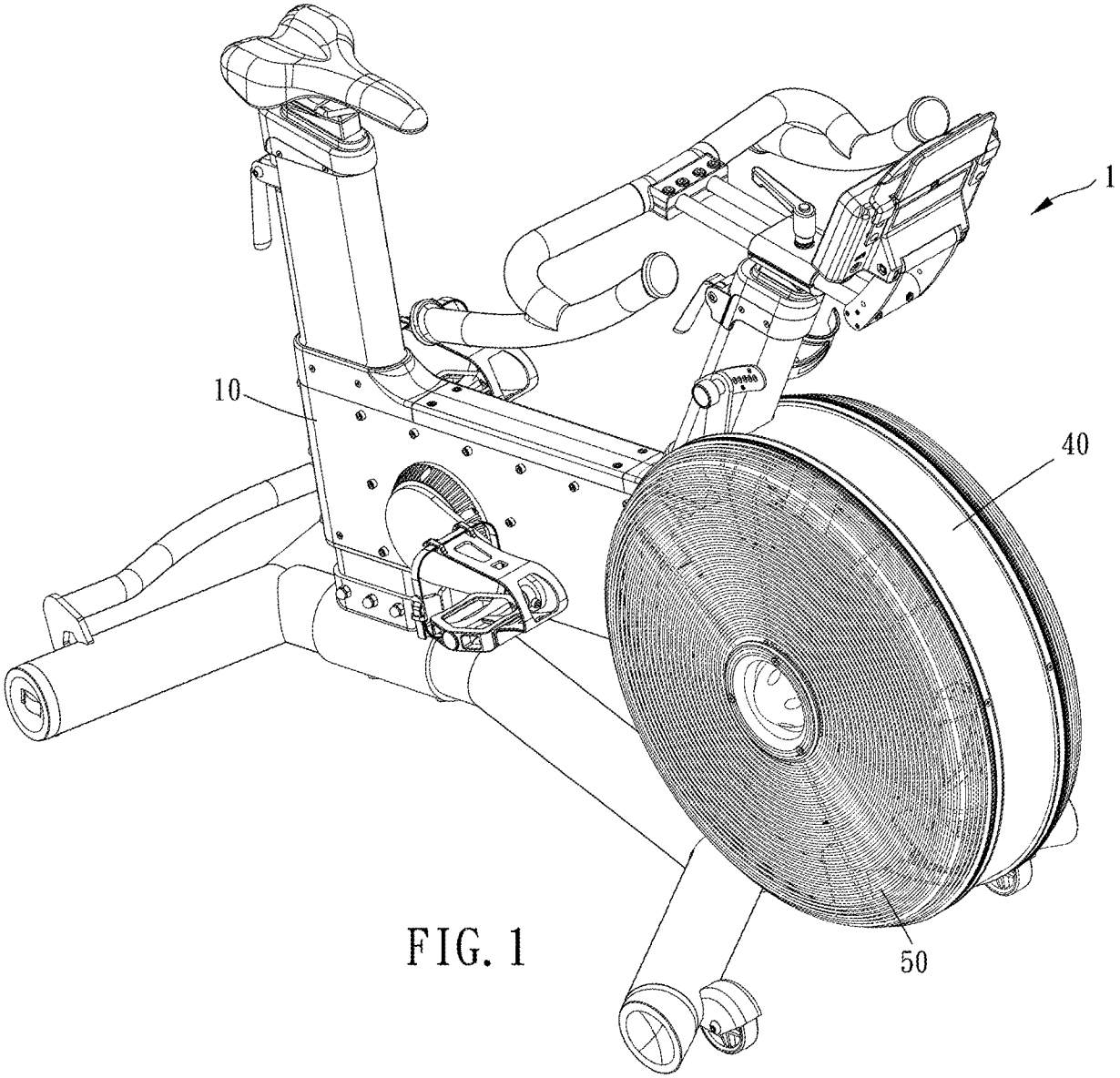
FIG. 1 is a stereogram of a preferable embodiment of the present invention.
Figure 2:
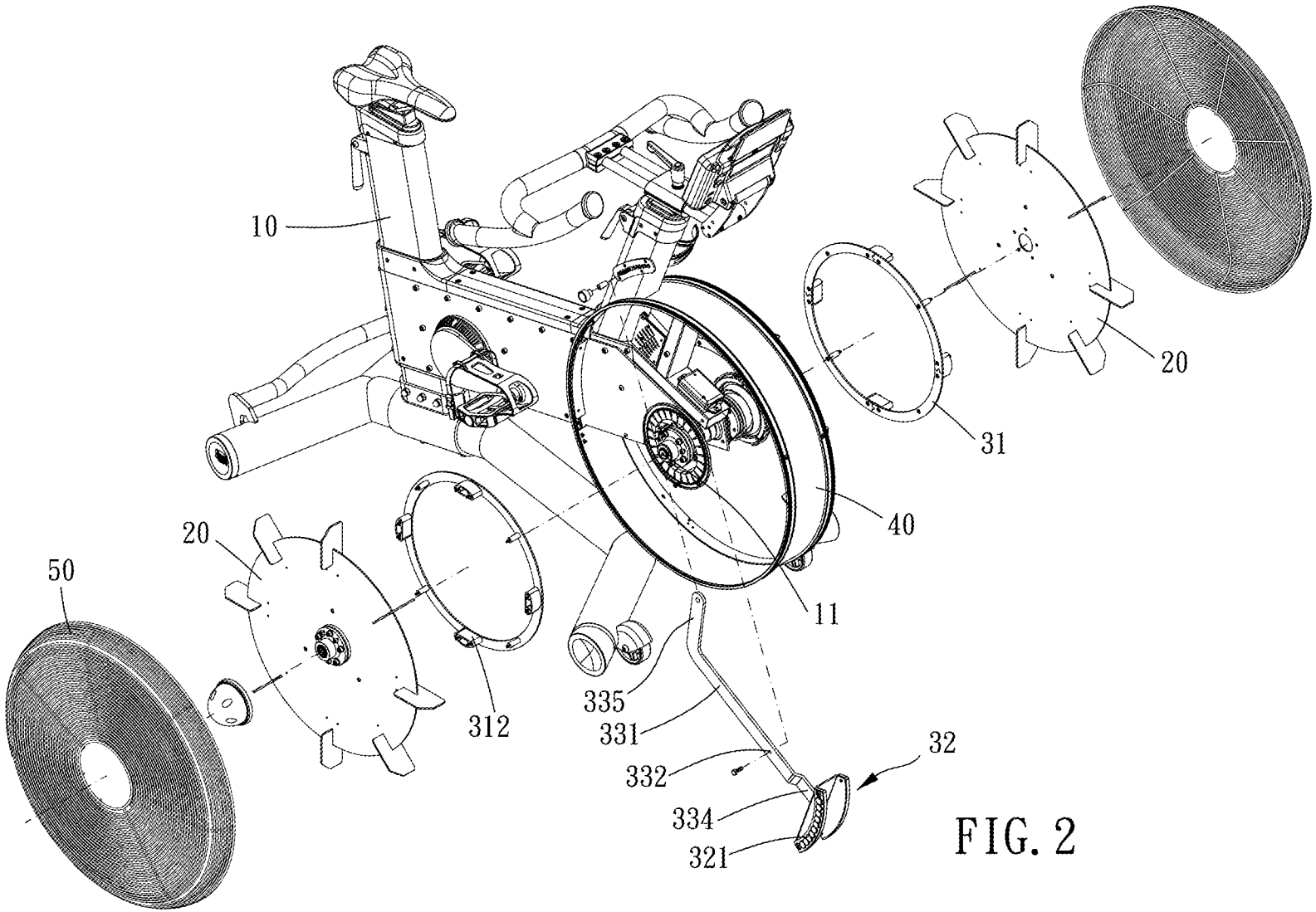
FIG. 2 is a breakdown drawing of a preferable embodiment of the present invention.
Figure 3:
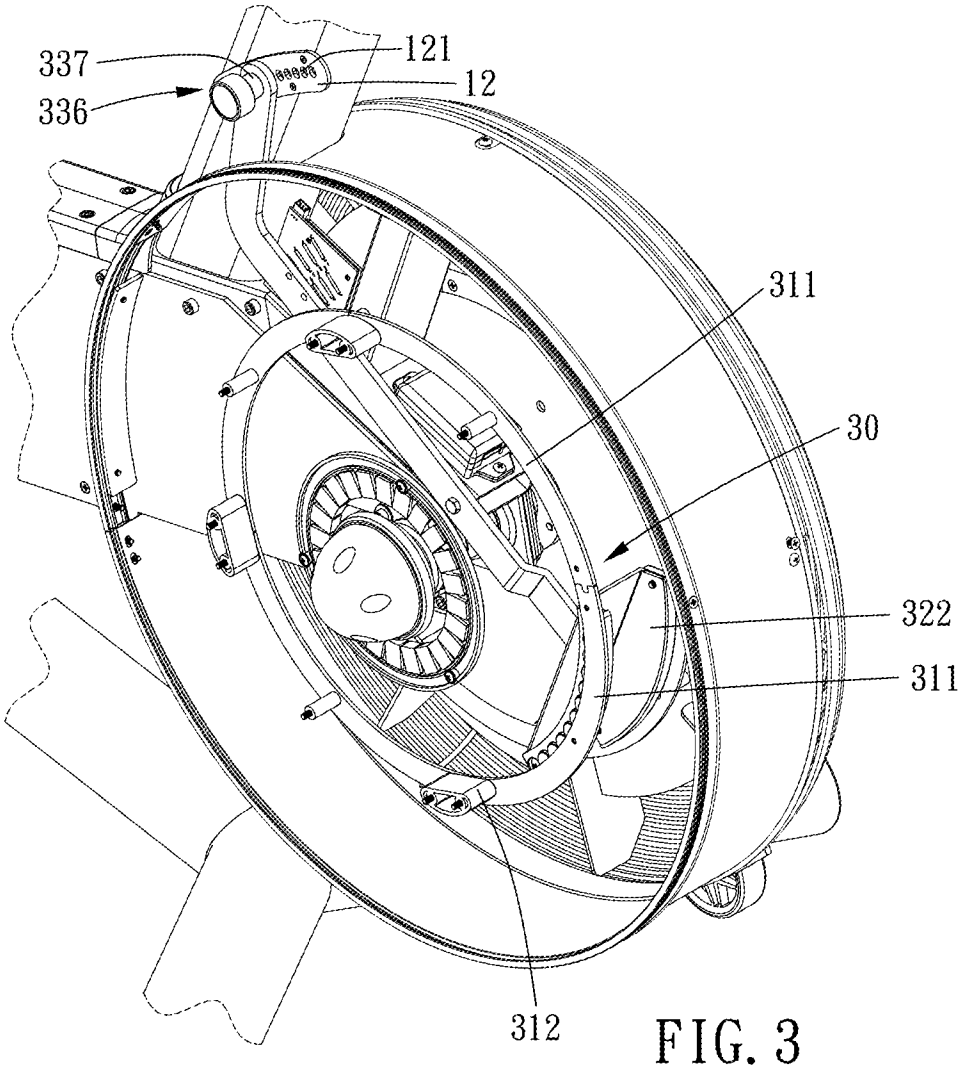
FIG. 3 is a partial enlargement of a preferable embodiment of the present invention.
Figure 4:
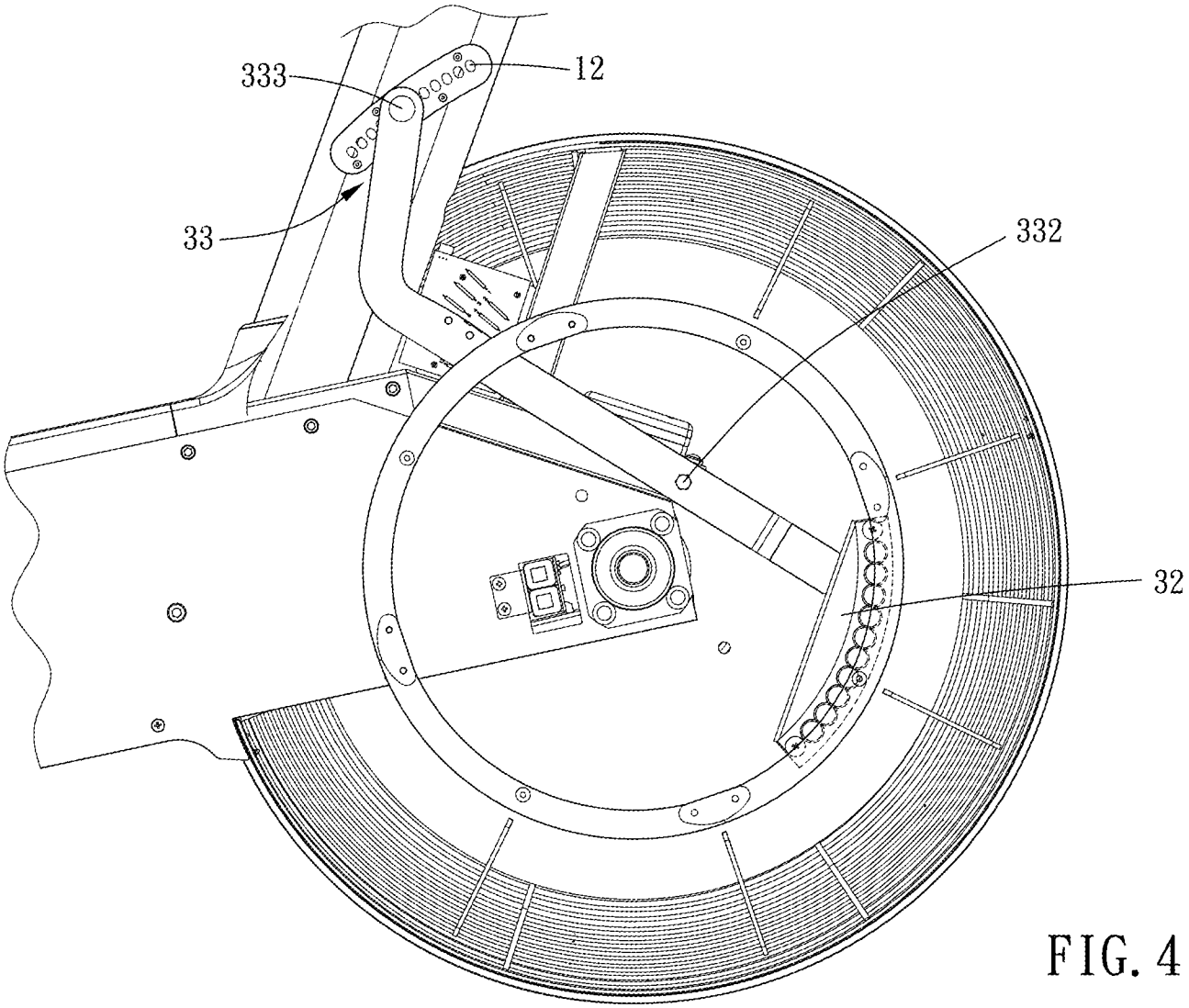
FIGS. 4 to 6 are schematic diagrams showing operation of a preferable embodiment of the present invention.

Please refer to FIGS. 1 to 6 for a preferable embodiment of the present invention. An exercise device 1 of the present invention includes a main body 10, two fan wheels 20 and a magnetic resistance assembly 30.

The main body 10 includes an axle 11 disposed thereon. The two fan wheels 20 are connected to the axle 11 and rotatable relative to the main body 10. The magnetic resistance assembly 30 includes two magnetoresistive rings 31 disposed respectively on the two fan wheels 20 and around the axle 11, a magnetic unit 32 and a controlling unit 33. The magnetic unit 32 includes two magnetic portions 321 respectively corresponding to the two magnetoresistive rings 31. The controlling unit 33 includes a lever 331 rotatably disposed on the main body 10 at a pivot point 332, and the magnetic unit 32 and an operating portion 333 are disposed on the lever 331 and located by two opposite sides with respect to the pivot point 332. The pivot point 332 and the axle 11 are eccentrically arranged. Movement of the two magnetic portions 321 driven by the lever 331 changes magnetic active force between the two magnetic portions 321 and the two magnetoresistive rings 31. Therefore, the two fan wheels 20 and the magnetic resistance assembly 30 provide sufficient operating resistance and the magnetic resistance assembly 30 has a simple structure and is easy to adjust.

The lever 331 includes a first end 334 and a second end 335 located at two opposite sides of the pivot point 332. The magnetic unit 32 is disposed at the first end 334, the operating portion 333 is disposed at the second end 335, and the second end 335 is adjustably positioned on the main body 10. The main body 10 further has a first engaging portion 12, and the second end 335 has a second engaging portion 336 which is engageable with the first engaging portion 12 so as to adjustably position the magnetic unit 32. Specifically, one of the first engaging portion 12 and the second engaging portion 336 includes at least one engaging convex, and the other of the first engaging portion 12 and the second engaging portion 336 includes at least one engaging concave. In this embodiment, the first engaging portion 12 includes a plurality of said engaging concaves 121 spacingly disposed on the main body 10, and the second engaging portion 336 includes one said engaging convex 337 protruding toward the first engaging portion 12, which has a simple structure and is easy to operate. Preferably, a distance between the magnetic unit 32 and the pivot point 332 is shorter than a distance between the operating portion 333 and the pivot point 332 so that a swinging path of the operating portion 333 is longer than a swinging path of the magnetic unit 32 and a position of the magnetic unit 32 is accurately and finely adjustable. However, the distance between the magnetic unit and the pivot point may be equal to or larger than the distance between the operating portion and the pivot point.

The two magnetoresistive rings 31 are made of magnetic metal so as to generate magnetic resistance with the magnetic unit 32 during rotation. Each of the two magnetoresistive rings 31 includes a plurality of segments 311 and a plurality of connecting members 312, and each of the plurality of connecting members 312 detachably connects adjacent two of the plurality of segments 311, which is easy to assemble, maintain and replace. However, the two magnetoresistive rings may be integrally made in one piece, respectively. The plurality of connecting members 312 are detachably connected between the two fan wheels 20 and the two magnetoresistive rings 31. In other words, each of the two fan wheels 20 and one of the two magnetoresistive rings 31 are spacingly connected with each other by part of the plurality of connecting members 312 so that the two magnetoresistive rings 31 are axially closer to the two magnetic portions 321 for preferable magnetic resistance effect.

Figure 5:
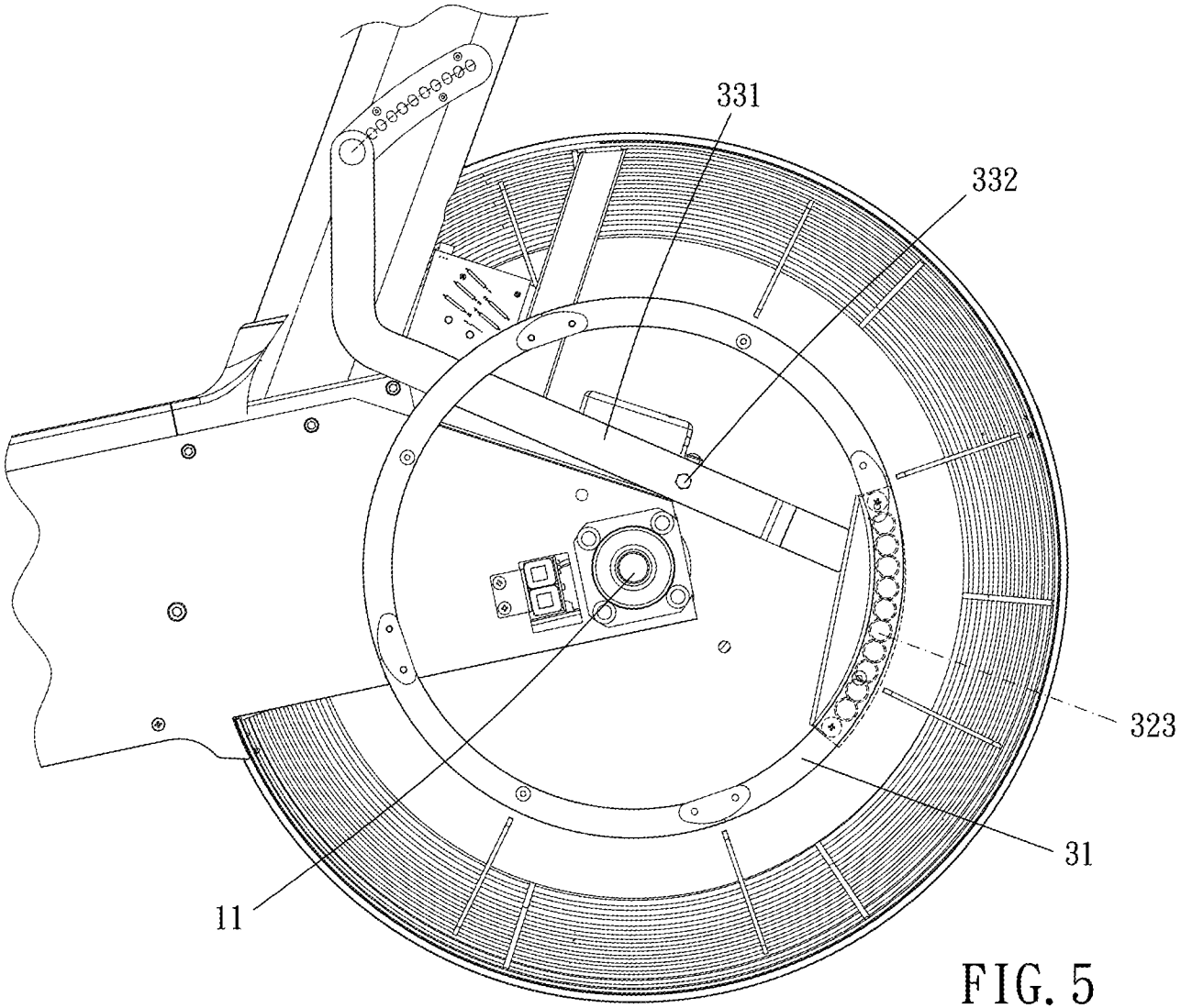
Figure 6:
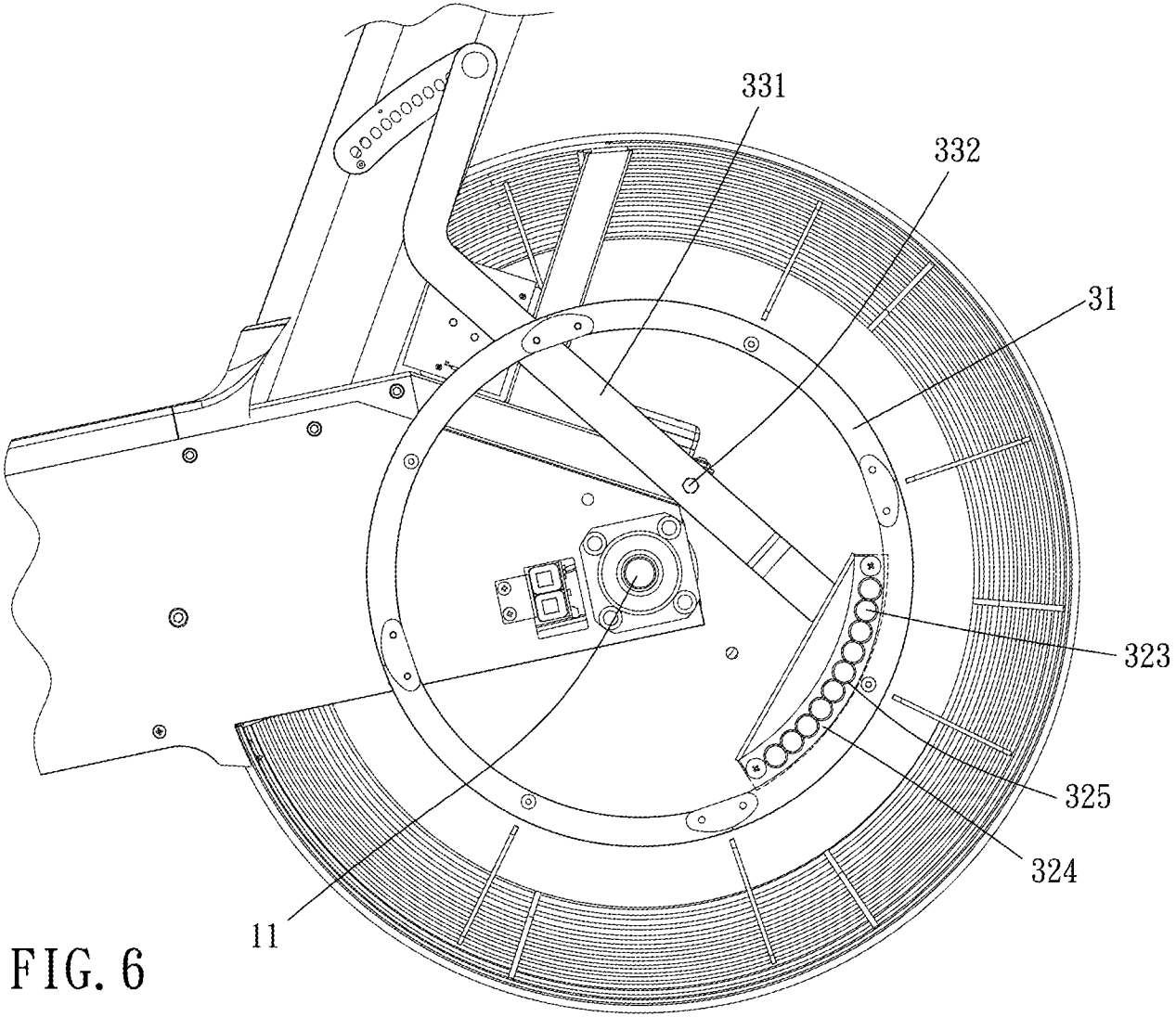

The magnetic unit 32 further includes a base 322 located between the two magnetoresistive rings 31 and integrally connected with the lever 331, and the two magnetic portions 321 are disposed on two opposite sides of the base 322 and each include at least one magnet 323 which has an arrangement corresponding to part of one of the two magnetoresistive rings 31 so as to have preferable magnetic resistance effect. In this embodiment, each of the two magnetic portions 321 includes a receiving member 324 which is detachably disposed on the base 322 and has a plurality of recessions 325 receiving the at least one magnet 323 so that the receiving member 324 is replaceable to receive magnets with different shapes and a number of the at least one magnet 323 received within the plurality of recessions 325 are adjustable according using requirements; arrangement of the plurality of recessions 325 corresponds to the part of one of the two magnetoresistive rings 31. In other embodiments, the at least one magnet may have a shape corresponding to the part of one of the two magnetoresistive rings and be directly attached to the base. The two magnetic portions 321 are movable relative to the two magnetoresistive rings 31 between a first position and a second position. When the two magnetic portions 321 are in the first position, the at least one magnet 323 of each of the two magnetic portions 321 is entirely axially overlapped with the two magnetoresistive rings 31 so as to provide maximum magnetic resistance between the two magnetic portions 321 and the two magnetoresistive rings 31, as shown in FIG. 5; when the magnetic portions 321 are in the second position, the at least one magnet 323 of each of the two magnetic portions 321 is axially dislocated with the two magnetoresistive rings 31 so as to provide minimum magnetic resistance between the two magnetic portions 321 and the two magnetoresistive rings 31, as shown in FIG. 6.

The exercise device 1 further includes a casing 40 and two protecting grilles 50. The casing 40 is disposed on the main body 10 and surrounds the two fan wheels 20, and the two protecting grilles 50 are detachably disposed on two opposite sides of the casing 40 and cover the two fan wheels 20, which allows air circulation and avoids direct contact with the two fan wheels 20. However, the two protecting grilles may be directly connected with each other without the casing.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An exercise device, including:

a main body, including an axle disposed thereon;

two fan wheels, connected to the axle and being rotatable relative to the main body;

a magnetic resistance assembly, including two magnetoresistive rings disposed respectively on the two fan wheels and around the axle, a magnetic unit and a controlling unit, the magnetic unit including two magnetic portions respectively corresponding to the two magnetoresistive rings, the controlling unit including a lever rotatably disposed on the main body at a pivot point, and the magnetic unit and an operating portion being disposed on the lever and located by two opposite sides with respect to the pivot point, the pivot point and the axle being eccentrically arranged, movement of the two magnetic portions driven by the lever changing magnetic active force between the two magnetic portions and the two magnetoresistive rings.

2. The exercise device of claim 1, wherein the lever includes a first end and a second end located at two opposite sides of the pivot point, the magnetic unit is disposed at the first end, the operating portion is disposed at the second end, and the second end is adjustably positioned on the main body.

3. The exercise device of claim 2, wherein the main body further has a first engaging portion, and the second end has a second engaging portion which is engageable with the first engaging portion.

4. The exercise device of claim 1, wherein a distance between the magnetic unit and the pivot point is shorter than a distance between the operating portion and the pivot point.

5. The exercise device of claim 1, wherein each of the two magnetoresistive rings includes a plurality of segments and a plurality of connecting members, and each of the plurality of connecting members connects adjacent two of the plurality of segments.

6. The exercise device of claim 5, wherein the plurality of connecting members are detachably connected between the two fan wheels and the two magnetoresistive rings.

7. The exercise device of claim 1, wherein the magnetic unit further includes a base located between the two magnetoresistive rings and connected with the lever, and the two magnetic portions are disposed on two opposite sides of the base and each include at least one magnet.

8. The exercise device of claim 1, wherein the two magnetic portions each include at least one magnet which has an arrangement corresponding to part of one of the two magnetoresistive rings, the two magnetic portions are movable relative to the two magnetoresistive rings between a first position and a second position; when the two magnetic portions are in the first position, the at least one magnet of each of the two magnetic portions is entirely axially overlapped with the two magnetoresistive rings; when the magnetic portions are in the second position, the at least one magnet of each of the two magnetic portions is axially dislocated with the two magnetoresistive rings.

9. The exercise device of claim 1, further including a casing and two protecting grilles, wherein the casing is disposed on the main body and surrounds the two fan wheels, and the two protecting grilles are detachably disposed on two opposite sides of the casing and cover the two fan wheels.

* * * * *